US010336405B1

(12) United States Patent
Ratigan et al.

(10) Patent No.: US 10,336,405 B1
(45) Date of Patent: Jul. 2, 2019

(54) REMOVABLE COVER

(71) Applicants: Michael Ratigan, Elon, NC (US); Edward Ratigan, Graham, NC (US)

(72) Inventors: Michael Ratigan, Elon, NC (US); Edward Ratigan, Graham, NC (US)

( * ) Notice: Subject to any disclaimer, the term of this patent is extended or adjusted under 35 U.S.C. 154(b) by 26 days.

(21) Appl. No.: 15/420,320

(22) Filed: Jan. 31, 2017

(51) Int. Cl.
*B63B 21/04* (2006.01)
*B63B 17/00* (2006.01)
*B63B 21/00* (2006.01)

(52) U.S. Cl.
CPC ..... *B63B 17/00* (2013.01); *B63B 21/00* (2013.01); *B63B 21/04* (2013.01); *B63B 2017/0045* (2013.01); *B63B 2021/003* (2013.01); *B63B 2710/00* (2013.01)

(58) Field of Classification Search
CPC ..... B63B 21/04; B63B 21/045; B63B 21/06; B63B 21/08; B63B 21/10; B63B 21/12; B63B 21/14; B63B 21/18; B63B 21/20; B63B 2021/203; B60J 11/00; B60J 11/02; B60J 11/025; B60J 11/04; B60J 11/06
See application file for complete search history.

(56) References Cited

U.S. PATENT DOCUMENTS 5,738,403 A * 4/1998 Tyson ..... B60J 11/00 296/136.02
5,816,185 A * 10/1998 Ruthrford ..... B60P 7/083 114/361
8,333,162 B2 12/2012 Chapman et al.
8,985,045 B2 3/2015 Bonfield et al.
9,003,993 B1 * 4/2015 Ratigan ..... B63B 21/04 114/219
9,265,291 B2 * 2/2016 Weber ..... A41D 13/0543
9,550,549 B1 * 1/2017 Ratigan ..... B63B 21/20
2015/0210150 A1 * 7/2015 Alexander ..... B63B 17/02 150/166

OTHER PUBLICATIONS

Three page website printout from "Nylacast.com" showing Nylacast Chock Liner, Copyright 2017.
"Abrasion and Fibre Fatigue in High Performance Synthetic Ropes for Ship Escort and Berthing", Suntec Convention Center, ITS 2008, Singapore, Day 3, Paper 4.
Maritime Application Rope Savers, commercially offered by Fluoron, Inc., at www.fluoron.com/bullnose_covers.htm.

* cited by examiner

*Primary Examiner* — Andrew Polay
(74) *Attorney, Agent, or Firm* — Tuggle Duggins P.A.; Blake Hurt

(57) ABSTRACT

A removable marine cover for protecting marine support structures such as bullnoses in addition to nautical lines from abrasive contact has a polymeric cover body including an outward surface attached to a material with a gripping portion is provided. The marine cover has a set of ratchet straps arranged around the periphery to securely attach the cover to the marine support structure. The inward surface may include a wear pad, and may further include a polyurethane coating to reduce the coefficient of friction experienced by the nautical lines while also protecting the support structure from degradation, which ultimately prevents damage to both the support structure and the nautical lines.

18 Claims, 5 Drawing Sheets

REMOVABLE COVER

FIELD OF THE INVENTION

The invention herein pertains to removable covers and particularly pertains to a removable cover for marine support structures such as a bullnose that prevents wear on associated mooring lines.

DESCRIPTION OF THE PRIOR ART AND OBJECTIVES OF THE INVENTION

Marine vessels often rely on ropes to secure them to a dock, tow, or anchor, which is a method of attachment that has been known in the art since antiquity. These ropes are generally positioned around or through structures such as cleats, bullnoses, bits, chocks, staples or the like. After the vessel is tied off, the motion of the water causes the vessel to rock or move, resulting in ropes that wear, chafe, or otherwise abrade against the support structure which over time compromises the rope holding capacity. Degradation or breakage of these ropes can lead to the vessel drifting away from an assigned location, potentially causing damage to the vessel as well as surrounding structures and neighboring vessels. To prevent the degradation of these mooring lines, they are periodically replaced at generally high cost to the vessel owner. The ropes that are generally utilized in large marine vessels and for towing these types of vessels, for example by tugboats, are typically of a large diameter with robust structural construction, resulting in a large and expensive rope. Additionally, the marine environment, particularly for ocean-going vessels, produces extreme cases such as ice, wind, and salt, all which can factor in the degradation of ropes as well as the rope support structure. Maintenance for the support structure may also be necessary to minimize chipping paint, the accumulation of rust, and the development of rough surfaces that may accelerate the wear on the ropes.

Attempts to alleviate this problem have been tried in the past with limited success. Coating of ropes has not solved the problem (see *Abrasion and Fibre Fatigue in High Performance Synthetic Ropes for Ship Escort and Berthing*, Suntec Convention Center, ITS 2008, Singapore, Day 3, Paper 4). Coating of the support structures has not worked (see Maritime Application Rope Savers, commercially offered by Fluoron, Inc., at www.fluoron.com/bullnose_covers.htm, last visited 1 Nov. 2016). Even altering the construction of the support structure to include a covering material such as polyethylene, or permanently affixing the polyethylene to the support structure, has failed to solve this dilemma of rope and structure eventually becoming damaged and needing to replace both (see U.S. Pat. No. 8,333,162 to Chapman et al.).

Thus, in view of the problems and disadvantages associated with prior art devices, the present invention was conceived and one of its objectives is to provide a removable marine support structure covering.

It is another objective of the present invention to provide a removable structure cover that can be positioned in either an upwards or a downward position.

It is still another objective of the present invention to provide a removable structure cover that includes a woven fabric and a polymeric covering.

It is yet another objective of the present invention to provide a removable structure cover including one or more adjustable tensioning members.

It is a further objective of the present invention to provide a removable structure cover with a series of ratchet strap fasteners affixed about the periphery of the cover body.

It is still a further objective of the present invention to provide a removable structure cover with at least four straps and associated ratchet fasteners positioned approximately equidistant about the periphery of the cover body.

It is yet a further objective of the present invention to provide a removable structure cover with a fifth ratchet strap positioned in a substantially vertical position (i.e. perpendicular to the horizon) about the periphery of the cover body.

It is another objective of the present invention to provide a removable structure cover with a surface at least partially covered with a polymeric coating.

It is still another objective of the present invention to provide a removable structure cover including at least a portion of material that defines a significantly greater coefficient of friction than the body of the cover.

Various other objectives and advantages of the present invention will become apparent to those skilled in the art as a more detailed description is set forth below.

SUMMARY OF THE INVENTION

The aforesaid and other objectives are realized by providing a removable marine cover formed from a cover body made of a woven nylon material with two or more straps extending laterally therefrom, at least one of the straps engaged to a tensioning member in the embodiment of a ratchet for affixing the marine cover to the inner surface of a marine support structure such as a bullnose. The straps are intended to prevent the inadvertent displacement of the marine cover relative to the support structure which causes wearing, but the torsional forces exerted on the cover by the lines extending from vessels riding at anchor and frictionally contacting the cover when placed over the support structure are often too great, particularly in view of the aquatic nature of the typical operating environment. Therefore, the cover also includes a portion of gripping material defining a significantly greater coefficient of friction that the cover body, this portion of material positioned and oriented such that when the marine cover is deployed about the support structure, the portion of material frictionally engages the surface of the support structure and prevents the inadvertent displacement of the marine cover described above. Further, the marine cover also has a polymeric coating applied to the surface of the marine cover opposite that of the portion of gripping material to smooth the passage of the nautical lines through the support structure during use. This polymeric coating has the added benefit of curing in place, meaning that the marine cover can become formed about the support structure for greater structural stability and longevity.

DETAILED DESCRIPTION OF THE PREFERRED EMBODIMENT AND OPERATION OF THE INVENTION

Figure 1:
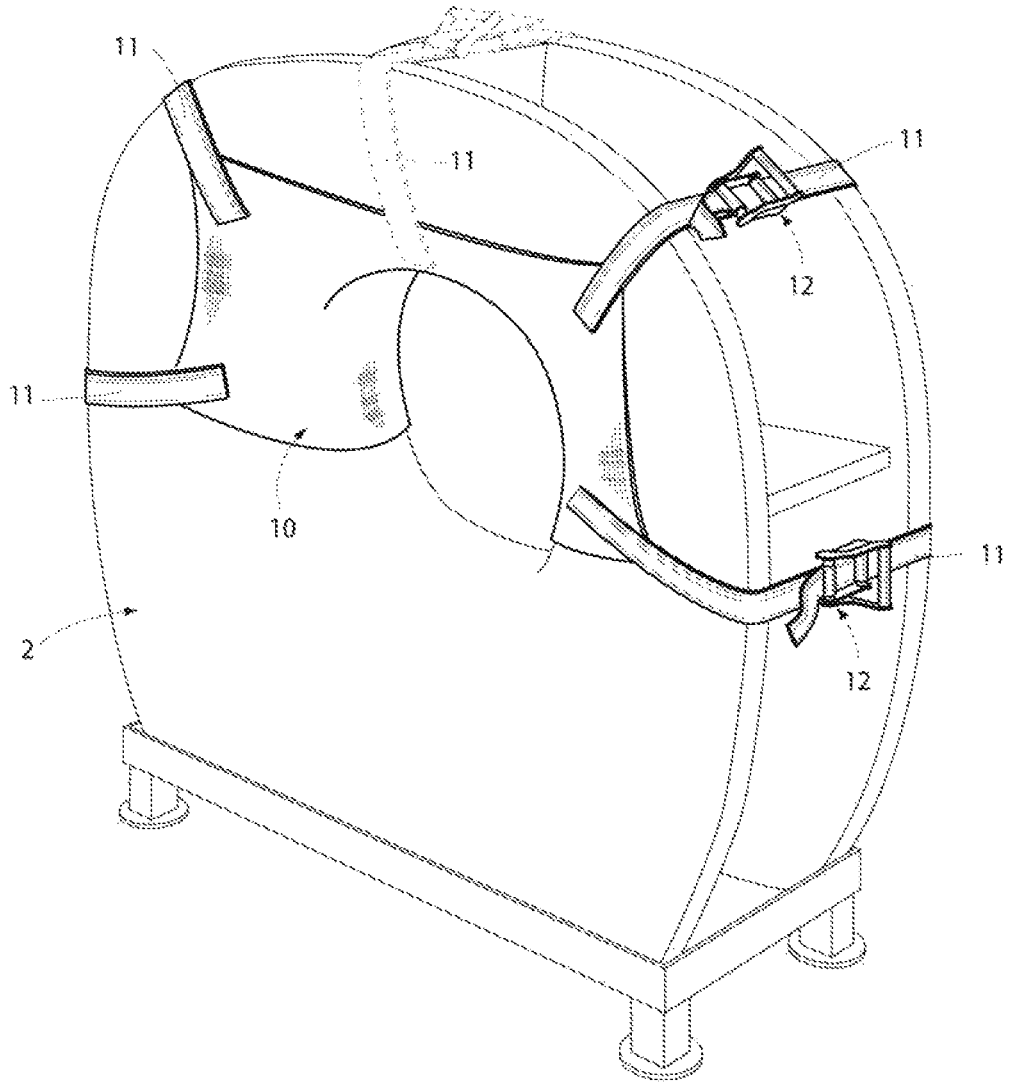
FIG. 1 shows an environmental view of an embodiment of a removable marine cover positioned about a nautical support structure.

For a better understanding of the invention and its operation, turning now to the drawings, FIG. 1 shows an embodiment of removable marine cover 10 with straps 11 tightened about support structure 2 via tensioning members 12. As used herein, the term "marine cover" is intended to provide context to the typical operating environment of cover 10, and although it indicates the primary intended use of cover 10, the use of the illustrative tetra should not be construed as a limitation on the recited structure that comprises cover 10. Similarly, "marine support structure" or "support structure" are terms used to identify members that may be commonly encountered in the nautical industry, including (but not limited to) cleats, bullnoses, bits, chocks, staples or the like. It should be understood that marine cover 10 may be cooperatively deployed with these, and other, structural members to serve its intended purpose, which is to provide a protective barrier with smooth and structurally stable surfaces between support structure 2 and the nautical lines (not shown) that typically encounter the same.

Figure 2:
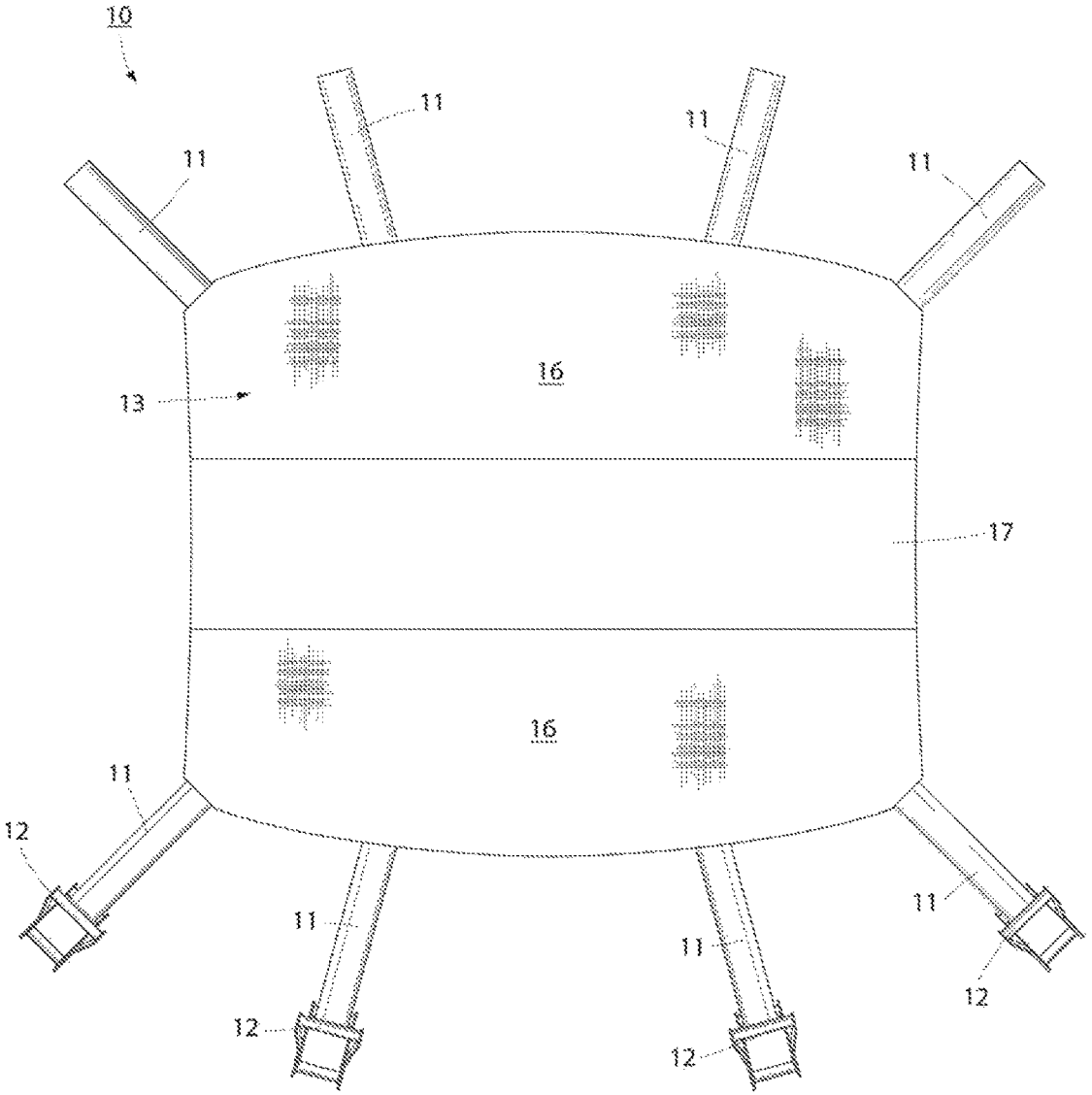
FIG. 2 pictures a top plan view of the marine cover of FIG. 1.
Figure 3:
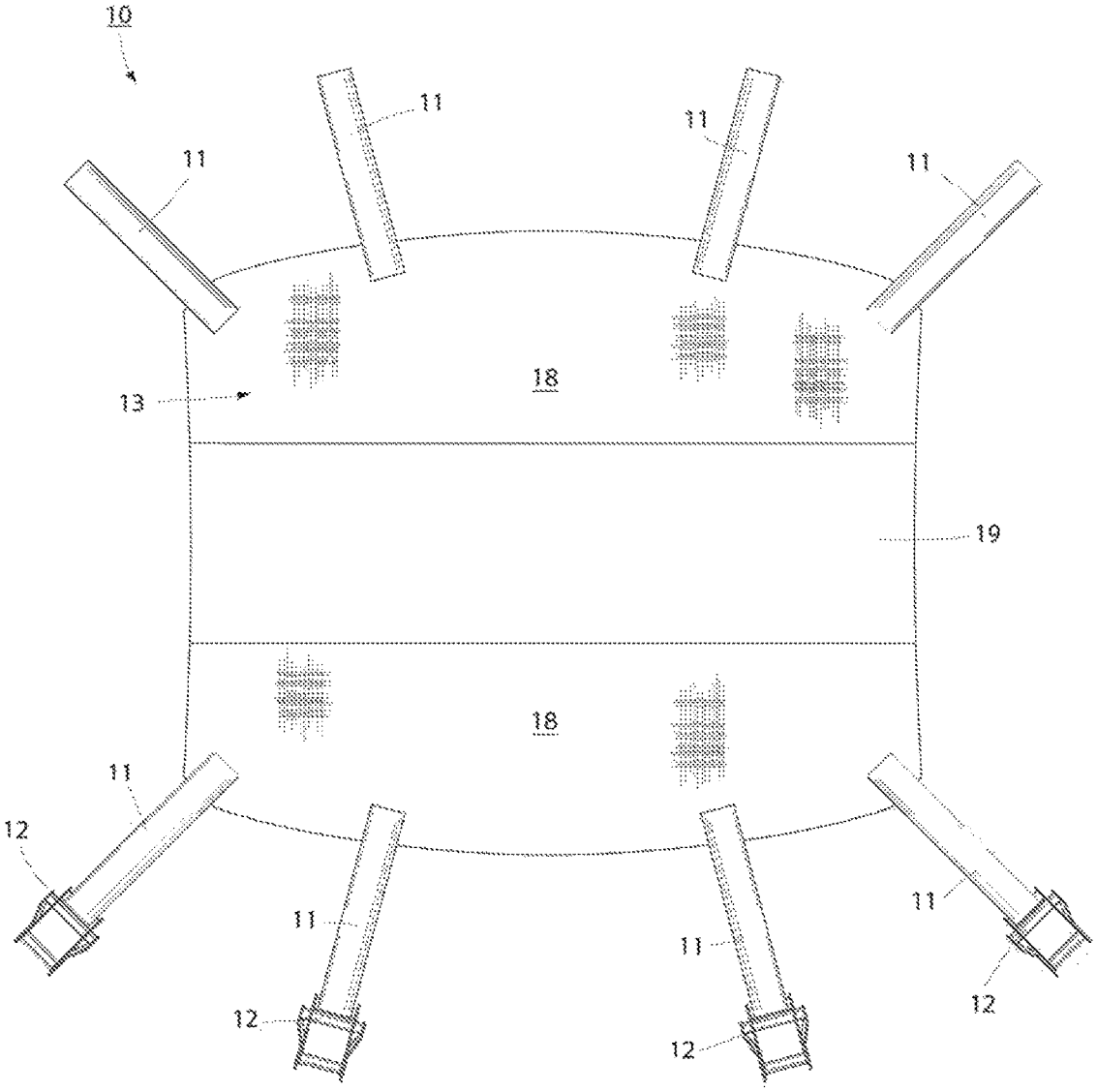
FIG. 3 depicts a bottom plan view of the marine cover of FIG. 1.
Figure 4:
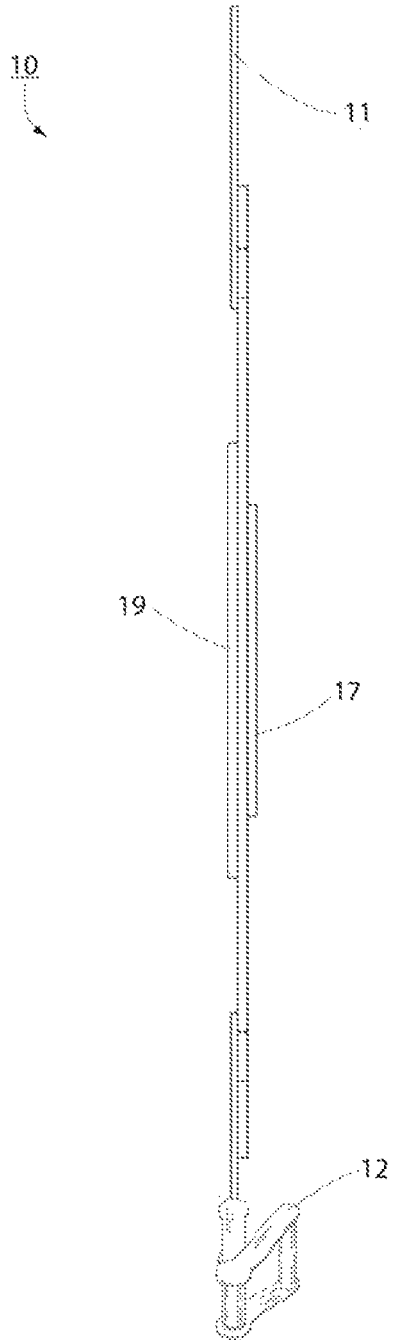
FIG. 4 demonstrates an elevated end view of the marine cover of FIG. 1, the opposing end presenting an identical mirror image.

As pictured in the top plan, bottom plan, and elevated end views of FIGS. 2-4, marine cover 10 is formed substantially from cover body 13. The preferred embodiment of cover body 13 defines an elongated square or rectangular shape and is defined by a woven material selected for its resistance to degradation, abrasion, and rot due to excessive exposure to abrasion and moisture over time. The preferred material which defines cover body 13 is a polymeric material such as nylon, although it should be understood that other polymeric and non-polymeric materials may also satisfy these criteria, and thus should be considered within the scope of the instant disclosure. Similarly, a conventional weave pattern is preferred for simplicity, efficiency of production, and structural stability related to cover body 13, but other woven and non-woven orientations of the material that makes up cover body 13 may serve as well, and thus should be considered within the scope of the instant disclosure.

As depicted clearly in FIGS. 1-3, cover body 13 serves as the anchoring mount for a plurality of elongated members such as straps 11 which extend laterally from the respective longitudinal sides of cover body 13. Although the length, width, and number of straps 11 is not intended to be limited, the preferred embodiment of marine cover 10 includes four pairs of straps 11, for a total of eight total straps 11, all defining the same length and width. As demonstrated in FIG. 1 in dotted fashion, a fifth pair of straps 11 may be advantageous and thus desirable to pass substantially vertically over the top of support structure 2, thereby more effectively preventing the inadvertent displacement of marine cover 10 when deployed on an embodiment of support structure 2 where it may be expected that the upper portion of the support structure would encounter more frictional contact with nautical lines (not shown) than the middle or lower portions of support structure 2 (see FIG. 5 for comparison). Similar to the construction of cover body 13, straps 11 are preferably formed from a polymeric material such as nylon, and in the preferred embodiment are formed from the same material as that which defines cover body 13, although such is not required.

Tensioning member 12 may be positioned proximate the terminal end of one of the pairs of straps 11 and oriented to engage the other of the pair in a selective manner, such that the tension applied to the respective pair of straps 11, for example when selectively tightening about or around marine support structure 2, may be applied in an increasing manner or alleviated in a reducing manner (i.e. progressive tightening or loosening). In the preferred embodiment, tension member 12 is defined by a conventional ratchet strap as shown in FIG. 1. As would be understood, a first strap 11 may be statically affixed to the ratchet body, for example by passing a mechanical fastener through a loop formed by the first strap and connecting the fastener, and thus first strap 11, to the ratchet body. The opposing end of first strap 11 is connected to cover body 13, for example by sewing, adhesive, mechanical fastener, or the like. A second strap 11 is passed through a rotating cylinder, usually through a slot or other opening, with the remainder passing out of the ratchet in opposing relation relative to the portion that entered the cylinder. As the ratchet is engaged (usually manually), the cylinder turns and the second strap 11 is wound progressively tighter around the cylinder, exerting increasing tension along second strap 11, until the desired tension is achieved. If tension is no longer desired, a release may be engaged to unspool second strap 11 from the cylinder, absolving the tension. Like first strap 11, the end of second strap 11 opposite the end engaging tension member 12 is connected to cover body 13, for example by sewing, adhesive, mechanical fastener, or the like. While the ratchet/ratchet strap assembly is preferred for its ease of use, low cost, and general familiarity with the consuming public, it should be noted that other progressive strap-tensioning members are known in the art, and to the extent they can serve the purpose of progressively tensioning pairs of straps 11, they are considered within the scope of the instant invention.

Figure 5:
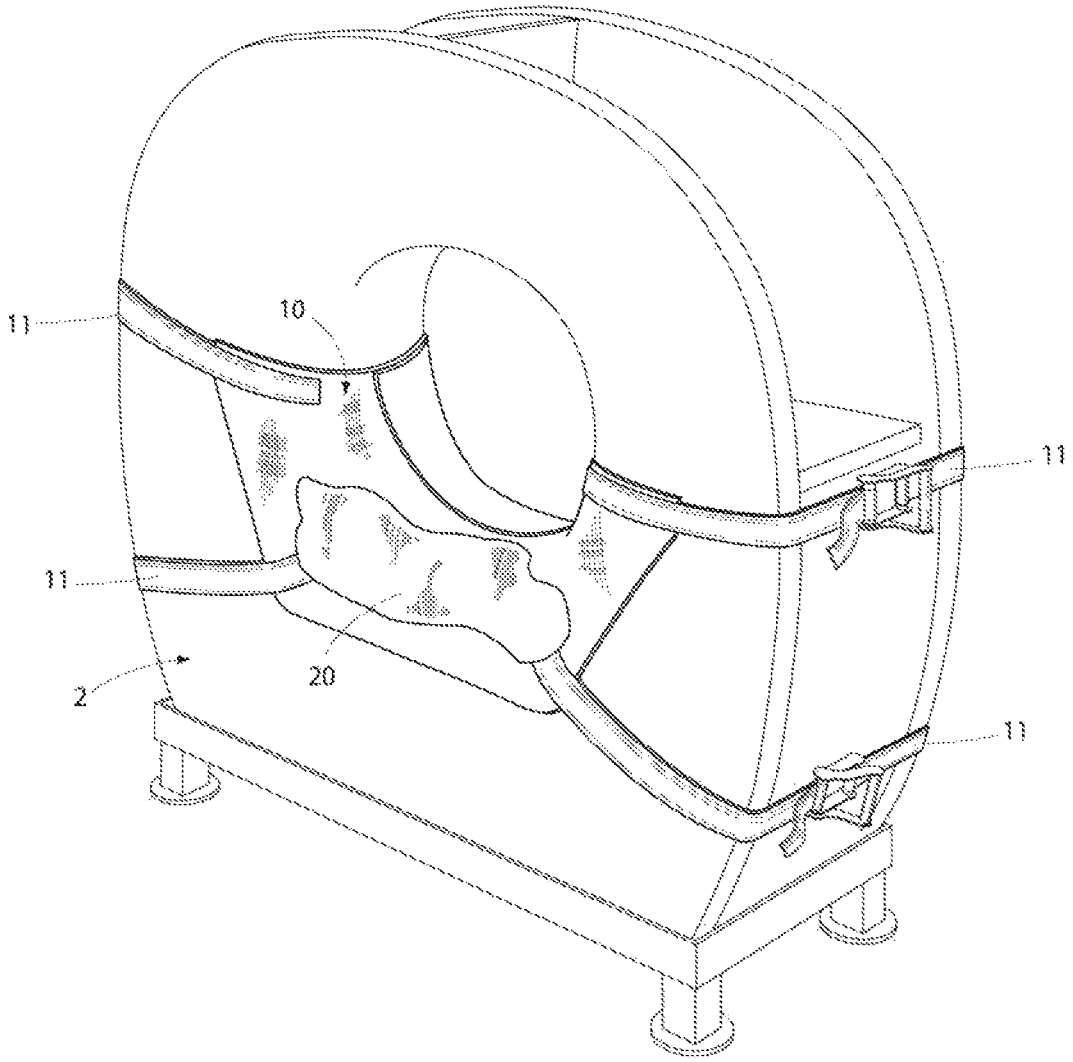
FIG. 5 illustrates an environmental view of a second embodiment of a removable marine cover positioned about a nautical support structure.

As demonstrated in FIGS. 1, 2, and 5, removable marine cover 10 may be releasably affixed to marine support 2 with an inward or interior-facing surface oriented in the direction away from support structure 2. It is inward surface 16 that frictionally engages the nautical lines (not shown) that are usually responsible for the abrasive impact on support structure 2. An embodiment of marine cover 10 may additional include wear pad 17, which is defined as an additional structure, preferably formed from a robust and/or reinforced fabric such as one formed from a para-aramid synthetic fiber (commercially known as Kevlar™). This wear pad may be deployed laterally or longitudinally across inward surface 16, ensuring that the nautical line contacts it at some point. As illustrated in FIG. 3, marine cover 10 defines an outward or exterior-facing surface oriented in the direction towards support structure 2. As would be understood, outward surface 18 frictionally engages support structure 2 in an effort to prevent chaffing from marine cover 10 on the surface of support structure 2. Cover body 13 imparts a certain tactile engagement with support structure 2, but due to the great forces common in the operating environment typical of marine cover 10, and further in consideration of the moisture nearly always present, it is desirable that the preferred embodiment of marine cover 10 include a gripping material affixed to outward surface 18 to impart a greater coefficient of friction than that bestowed by cover body 13, for the purpose of preventing inadvertent displacement of marine cover 10 during use. Although myriad structures may be capable of defining a coefficient of friction greater than that of cover body 13, preferred gripper portion 19 affixed to outward surface 18 defines a high coefficient of friction (at least 3.0 N while either wet or dry) relative to cover body 13. In the preferred embodiment, gripper portion 19 is defined by "Gripping Material", Product Number GM640, commercially available from 3M™, which is formed from a thermoplastic elastomer and a polymeric knit backing. This material defines thousand of micro-replicating gripping fingers (not shown in detail) that securely engage even smooth and/or wet surfaces. This somewhat soft material defines a hardness rating of 40 Shore A, is 33 millimeters (0.8 inches) thick and weighs 12.4 ounces per yard squared (420 g/m$^2$). This high durability material defines a dry kinetic coefficient of friction rating of 3.5 N and a wet kinetic coefficient of friction rating of 3.4 N in view of ASTMD-1894. In combination with pairs of straps 14 as described above, significant inadvertent displacement of marine cover 10 during use is all but impossible.

As described, marine cover 10 effectively reduces the abrasive impact of sodden nautical lines on the surface of support structures 2, and correspondingly protects nautical lines from degrading surfaces of support structures. However, in an embodiment of marine cover 10, inward surface 17 may be treated with a coating to further reduce the coefficient of friction between inward surface 17 and commercial nautical lines, as well as making marine cover 10 more impervious to moisture. Usually polymeric in nature, preferred coating 20 is defined by polyurethane, and more preferably is defined by the elastomer known as PureCast 603, commercially available from Industrial Polymer Corporation. This high performance, two-component liquid castable polyurethane elastomer is insensitive to moisture, exhibits low shrinkage, and cures in place over time, meaning that marine cover 10 will form to the marine support structure on which it is deployed, produces a more structurally stable abrasion shield than taught by the prior art. Additional embodiments may include UV resistant additives for additional protection against sun exposure, and color additives for source-identification.

A method of protecting both nautical lines and marine support structures includes providing marine cover 10 as described above, engaging gripper portion 19 on outward surface 18 of cover body 13 with the exterior surface of support structure 2, and fastening a plurality of straps 11 with tensioning members 15, such that marine cover 10 does not inadvertently displace about support structure 2 when biasing forces imparted from nautical lines are encountered by inward surface 16. Additional steps may include providing wear pad 17 on inward surface 16, providing a polymeric treatment, administering a polymeric coating 20 to at least inward surface 16, and curing polymeric coating 20.

The illustrations and examples provided herein are for explanatory purposes and are not intended to limit the scope of the appended claims.

We claim:

1. A marine cover for reducing line abrasion against support structures comprising a material with a gripper portion attached to an outward surface defined by a cover body formed from nylon, the gripper portion defining a coefficient of friction of at least 3.0 N while either wet or dry, and a pair of straps connected to the cover body, wherein the straps may be selectively tightened by at least one tensioning member.

2. The marine cover of claim 1 wherein the cover body is defined by woven nylon.

3. The marine cover of claim 1 wherein the at least one tensioning member is a ratchet.

4. The marine cover of claim 1 wherein the gripper portion defines a coefficient of friction greater than a coefficient of friction defined by the cover body.

5. The marine cover of claim 1 further comprises an inward surface defined by the cover body, wherein the gripper portion defines a coefficient of friction greater than a coefficient of friction defined by the inward surface.

6. The marine cover of claim 5 further comprises a coating positioned on the inward surface.

7. The marine cover of claim 6 wherein the coating is defined by polymeric material.

8. The marine cover of claim 7 wherein the coating is defined by a polyurethane.

9. The marine cover of claim 1 further comprises at least four pairs of straps.

10. The marine cover of claim 1 further comprises five pairs of straps, each pair of straps including a tensioning member joining the respective strap pair.

11. The marine cover of claim 10 wherein each tensioning member is a ratchet.

12. A removable marine cover for reducing line abrasion against support structures comprising a material with a gripper portion attached to an outward surface defined by a nylon cover body and a wear pad positioned on an inner surface defined by the nylon cover body, and a plurality of pairs of straps connected to the cover body and affixed about the periphery of the cover body, wherein the straps may be selectively tightened by at least one tensioning member.

13. The marine cover of claim 12 wherein the cover body is defined by woven nylon.

14. The marine cover of claim 12 wherein the gripper portion defines a coefficient of friction greater than a coefficient of friction defined by the inward surface.

15. The marine cover of claim 14 further comprises a polymeric coating positioned on the inward surface.

16. The marine cover of claim 12 further comprises at least four pairs of straps.

17. The marine cover of claim 16 wherein the at least one tensioning member is a ratchet.

18. The marine cover of claim 12, wherein the gripper portion defines a coefficient of friction of at least 3.0 N while either wet or dry.

* * * * *